United States Patent [19]

Richards

[11] 3,966,259

[45] June 29, 1976

[54] WET MOP HEAD CONSTRUCTION

[75] Inventor: Ernest Levon Richards, La Grange, Ga.

[73] Assignee: Deering Milliken Research Corporation, Spartanburg, S.C.

[22] Filed: Oct. 2, 1975

[21] Appl. No.: 618,850

Related U.S. Application Data

[62] Division of Ser. No. 523,884, Nov. 14, 1974, Pat. No. 3,924,289.

[52] U.S. Cl. ..... 300/21

[51] Int. Cl.[2] ..... A47L 13/20

[58] Field of Search ..... 300/16, 21

[56] References Cited

UNITED STATES PATENTS 3,324,497 6/1967 Moss ..... 300/21

3,644,958 2/1972 Moss ..... 300/21

*Primary Examiner*—Granville Y. Custer, Jr.
*Attorney, Agent, or Firm*—H. William Petry; L. J. Wilburn, Jr.

[57] ABSTRACT

A wet mop head construction and a method of making such construction comprising a pile fabric having an improved headband for attachment to the gripping elements of a wet mop tool and wherein the headband is comprised of a fabric material sewn about an end of the main body pile fabric portion with end portions of the headband extending from the pile fabric to partially cover and prevent the gripping elements of a mop tool from contacting a surface being treated by the mop head.

2 Claims, 5 Drawing Figures

WET MOP HEAD CONSTRUCTION

This is a division of application Ser. No. 523,884, filed Nov. 14, 1974, now U.S. Pat. No. 3,924,289, issued Dec. 9, 1975.

This invention relates to a wet mop head construction, and, more particularly, to a pile fabric wet mop head having an improved headband construction for attachment to a mop tool or handle for the application of liquids in the cleaning of floors.

Typically, prior art wet mop heads have been formed of plural cords of strands laid generally parallel and gathered at their mid point by a headband which is secured to the clamping jaws of a wet mop tool. The strands hang freely from the tool and are utilized to apply liquids, typically detergents, in the cleaning of floors and the like. End portions of the individual strands or cords of such wet mops may be connected by transverse bands or stitching to secure the individual cords in a generally bunched or fanned relationship to facilitate control of the strands during the mopping operation.

More recently, there has been developed a wet mop head construction of the free-hanging type wherein the mop head is composed of a pile fabric material suitably cut and sewn in a generally trapezoidal shape to form a flared, free-hanging material to be grippingly engaged at its headband by a mop tool. Such a pile fabric wet mop head construction is disclosed in copending, commonly assigned, U.S. patent application Ser. No. 523,885, filed Nov. 14, 1974. The present invention is directed to an improvement in the headband construction of such a pile fabric wet mop head which facilitates its engagement with the gripping elements of a mop tool and further protects the gripping elements from engagement with the surface, such as a floor of the like, being treated by the mop during use. The invention also concerns a method for making such a mop head construction.

More specifically, the present invention is directed to a pile fabric wet mop head construction of generally trapezoidal shape having a headband composed of a fabric which is sewn in overlying relation with the shorter parallel side of the main body portion of the pile fabric mop head, and with end portions of the headband extending outwardly from the sewn portions of the headband and the surface of the main body of the pile fabric construction to at least partially overlie the gripping elements of a mop tool and protect the elements from contact with the floor surface being cleaned or treated with the mop.

A preferred embodiment of the improved mop head construction of the present invention may be further described and better understood by reference to the accompanying drawings in which.

Figure 1:
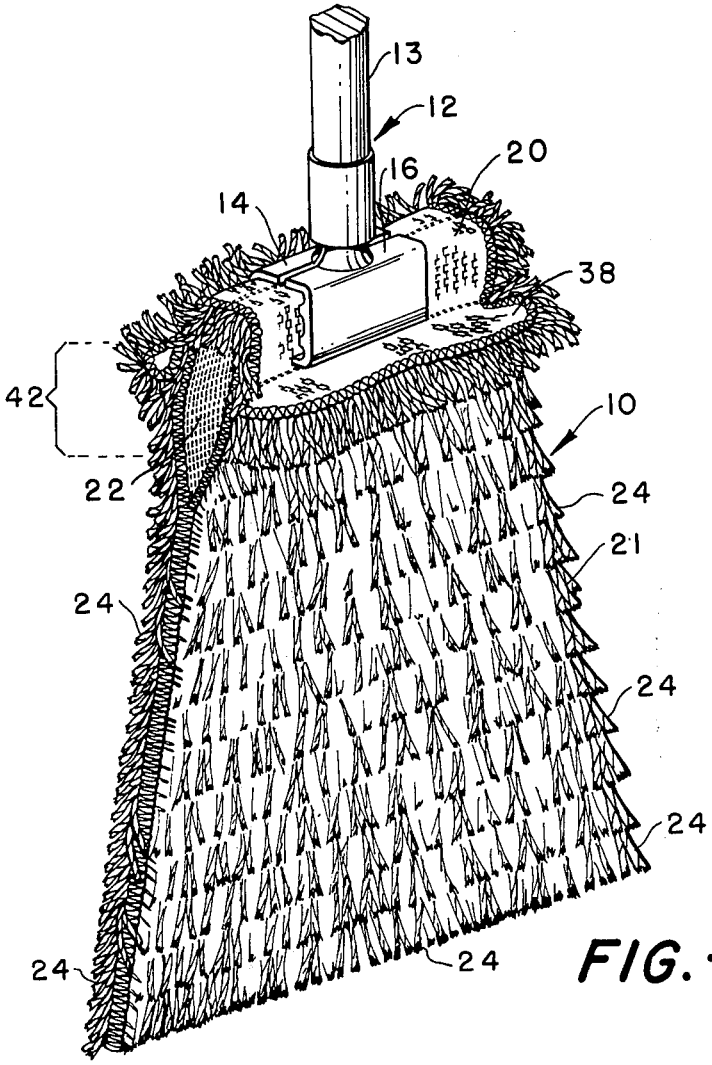
FIG. 1 is a perspective view of a wet mop head construction of the present invention attached to a typical wet mop support tool.

Referring more particularly to the drawings, FIG. 1 is a perspective view of a wet mop head construction 10 of the present invention which is attached for use to a wet mop tool 12. The mop handle 13 of the tool is provided with a pair of opposed elements or jaws 14, 16 which are pivotably connected in conventional manner to be moved toward and away from each other and grippingly engage the improved headband 20 of the mop head 10 during its use.

Figure 2:
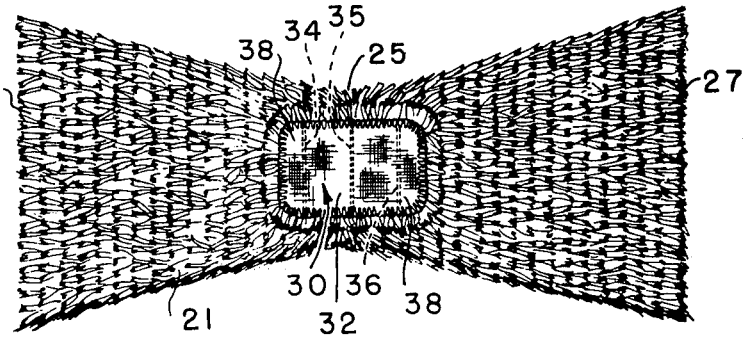
FIG. 2 is a plan view of the improved mop head construction of the present invention showing the realtionship of the component parts of the mop during a stage of its construction.

As seen in FIGS. 1 and 2 the main body 21 of mop head 10 is composed of a pile fabric comprising a base support sheet, such as a woven fabric 22, to which a plurality of pile yarns 24 are suitably attached, as by a conventional tufting operation.

Figure 3:
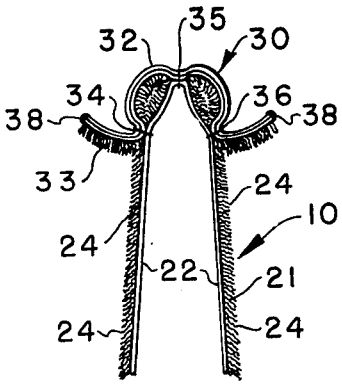
FIG. 3 is a side view of the mop head construction during a stage of its manufacture.
Figure 5:
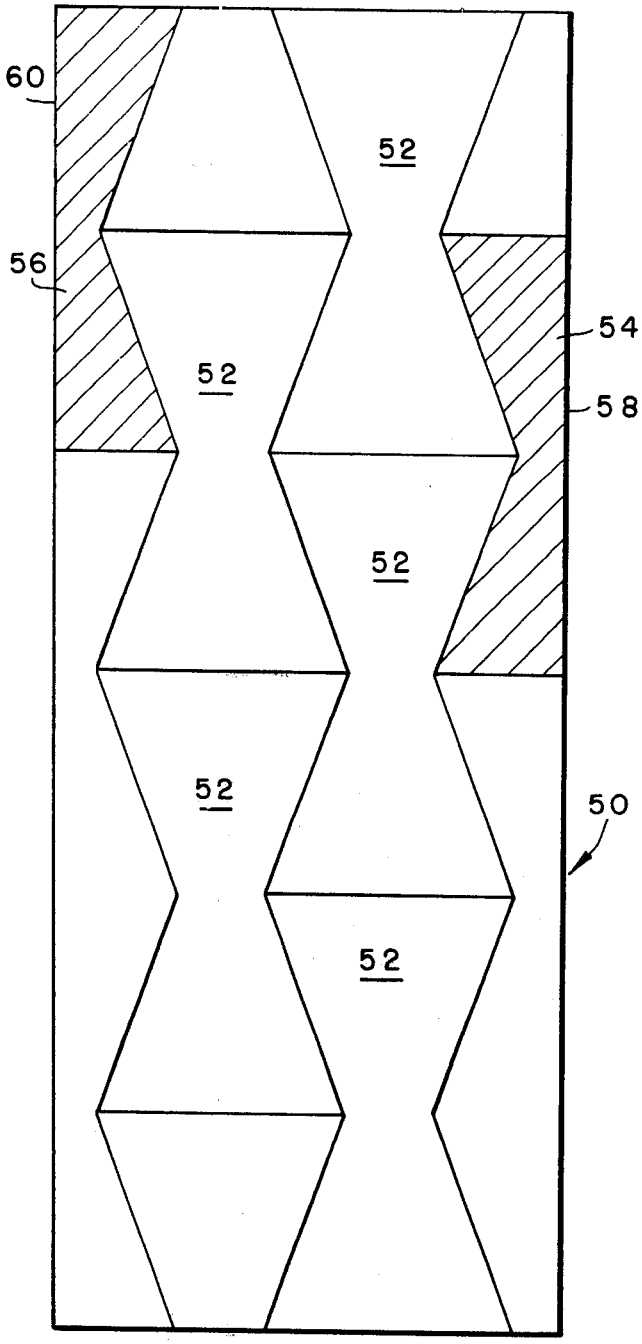
FIG. 5 is a plan view of a pile fabric showing the unique method by which fabric may be cut to form the main body portion of the wet mop head construction.

As seen in FIGS. 2, 3, and 5, the main body 21 of the mop is constructed from a pile fabric having a narrow center portion 25 which flares outwardly toward wider end portions 26, 27 such that the shape of the main body has an overall appearance of two similarly shaped trapezoids connected at their common shorter parallel side forming the central portion of the main body. Although the main body 21 is shown as a one piece construction, it could be composed of two generally trapezoidal sections suitably secured, as by sewing, along their short parallel side.

As best seen in FIGS. 2 and 3, the unique headband of the mop construction of the present invention is composed of a generally rectangular fabric 30, which preferably is a pile fabric of the type forming the main body portion, with a suitable backing of high friction surface material, such as a knit mesh nylon fabric 32, to provide additional support to the headband area and facilitate frictional engagement and retention of the headband by the gripping elements of the mop tool. In construction, the headband material is positioned over the narrow center portion of the main body, with the pile face 33 (FIG. 3) of the material placed in facing relation to the pile face of the main body 21. The headband is secured to the main body as by lines of stitching 34, 35, 36 (FIGS. 2 and 3), the outer lines 34, 36 being spaced inwardly from the end portions of the headband to provide a flap 38 of fabric on each side of the headband which overlies the gripping elements of the mop tool during use of the mop head to aid in preventing the gripping elements 14, 16 from marring or contacting the surface to which the mop is applied.

Although the headband of the present invention may be formed from any suitable material which provides sufficient strength for supporting the main body of the mop head in its attachment to a mop tool, it is preferred that the headband be formed of a pile material of the type shown and described. The pile yarns of the headband and the pile yarns of the main body portion of the mop provide additional bulk in the area of the headband that is gripped by the gripping elements of the mop tool, thus facilitating positive retention of the mop head on the tool during use. In addition, during the wiping action of the mop in use, the pile yarns of the free end portions of the headband provide a soft cushion effect in overlying the gripping elements of the mop tool and protect the floor surface from contact or influence of the elements. If desired, the free end portions or flaps 38 of the headband may be rolled or folded back against the seam lines 34, 36 securing the headband to the main body and secured thereto to form a more bulky protective roll of material to isolate the gripping elements of the tool from the floor.

After securing the headband to the main body of the mop, the main body is folded about the center stitch line 35 of the headband and the overlying side edges of the two flared portions of the main body 21 suitably sewn together to form the composite generally trapezoidal shaped construction shown in FIG. 1. FIG. 3 shows the overlying, or opposed, relationship of the folded mop fabric prior to its flaring side edges being sewn together, as seen in FIG. 1. Although the preferred embodiment of the mop construction of the present invention has the flaring side edges of the main body sewn together, with the outer end edges left unsewn to facilitate drying of the mop and to prevent collection of dirt or other contaminants from the interior of the mop, the flared free-hanging portions of the main body of the mop could be left unsewn along their side edges, if desired.

Figure 4:
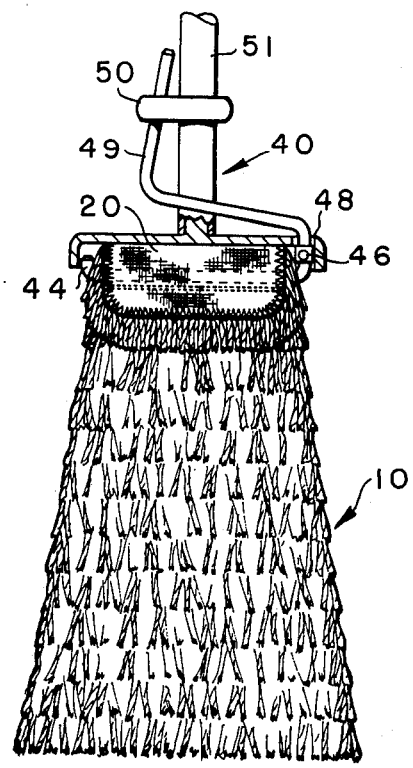
FIG. 4 is a front view of the mop head of the present invention showing its manner of attachment to a modified form of mop tool.

FIG. 4 illustrates the manner in which the construction of the present invention may be grippingly engaged by a mop tool 40 having different gripping elements from that shown in FIG. 1. As seen in FIG. 1, the upper portion 42 of each pair of flared side edges of the mop head construction 10 are left unsewn adjacent the headband 20 whereby the rod gripping element 44 of the mop tool 40, as shown in FIG. 4, may be inserted under the headband and the rod element pivoted about a pivot point 46 to matingly engage the rod element 44 with a trough-shaped gripping element 48 (shown in section) to retain the mop head in the mop tool. The handle 49 of the pivotal rod-shaped member is frictionally secured, in conventional manner, as by a sliding ring 50 surrounding the mop handle 51 and the rod gripping member handle 49.

The base sheet of the pile fabric may be formed of any suitable material, such as woven, knitted, nonwoven, or film type which has sufficient dimensional stability to provide good strength and dimensional stability to the mop head. Preferably, the base sheet may be of a hydrophobic type material, such as a woven nylon fabric, and the pile yarns may be composed of a hydrophilic type material such as cotton yarns or the like. Such a combination of hydrophobic and hydrophilic materials facilitates rapid drying of the mop after use, while retaining good liquid absorption characteristics and pick-up in the surface of the mop contacting the floor to be cleaned.

FIG. 5 is a plan view of a large portion of pile fabric material 50 illustrating a unique manner in which the main body of the mop may be efficiently and economically cut from a larger sheet of pile fabric. As shown, a multiplicity of double trapezoidal shaped sections 52 may be cut from a central portion of a continuous length of the pile fabric, with the adjacent sections along the length of the fabric being offset by one-half the length of the section. The remaining edge portions of the fabric may be cut into sections, two of which 54, 56 are illustrated by diagonal lined sections, and these sections sewn together along their longest straight sides 58, 60 to form an additional double trapezoidal shaped pile fabric suitable for being folded and sewn to form the main body of the mop head of the present invention.

That which is claimed is:

1. A method of producing a wet mop head construction for attachment to the gripping elements of a mop tool comprising the steps of

1. providing a pile fabric,

2. cutting a plurality of rows of generally double-trapezoidal shaped pieces from a portion of said pile fabric with side edges of adjacent rows of said pieces contiguous,

3. folding each of said double-trapezoidal shaped pieces about their common shorter parallel side with the pile faces of each piece forming outer faces of the folded piece,

4. attaching a headband to overlie the folded edge of each piece, and

5. securing the headband thereto.

2. A method as defined in claim 1 wherein said headband material is a substantially rectangular pile fabric and is attached to the folded edge portion inwardly of its ends to provide freely extending end portions of said headband.

* * * * *